US011152769B2

(12) United States Patent
Hirschmann et al.

(10) Patent No.: US 11,152,769 B2
(45) Date of Patent: Oct. 19, 2021

(54) OVERVOLTAGE PROTECTION ARRANGEMENT CONSISTING OF A HORN SPARK GAP ACCOMMODATED IN AN INSULATING HOUSING

(71) Applicant: DEHN SE + CO KG, Neumarkt/Opf. (DE)

(72) Inventors: Helmut Hirschmann, Berg (DE); Georg Wittmann, Lauterhofen (DE); Edmund Zäuner, Berching/Pollanten (DE); Ralph Brocke, Ilmenau/Oberpörlitz (DE); Sebastian Haas, Weigendorf (DE)

( * ) Notice: Subject to any disclaimer, the term of this patent is extended or adjusted under 35 U.S.C. 154(b) by 0 days.

(21) Appl. No.: 16/622,611

(22) PCT Filed: Jan. 30, 2019

(86) PCT No.: PCT/EP2019/052222
§ 371 (c)(1),
(2) Date: Dec. 13, 2019

(87) PCT Pub. No.: WO2019/166170
PCT Pub. Date: Sep. 6, 2019

(65) Prior Publication Data

US 2021/0151957 A1 May 20, 2021

(30) Foreign Application Priority Data

Feb. 27, 2018 (DE) ..... 102018104467.4
Jul. 5, 2018 (DE) ..... 102018116354.1

(51) Int. Cl.
*H01T 4/14* (2006.01)
*H01C 7/12* (2006.01)
(Continued)

(52) U.S. Cl.
CPC ..... *H01T 4/14* (2013.01); *H01C 7/12* (2013.01); *H01H 85/165* (2013.01);
(Continued)

(58) Field of Classification Search
CPC .... H01T 4/14; H01T 1/02; H01C 7/12; H01H 85/44; H01H 85/165
(Continued)

(56) References Cited

U.S. PATENT DOCUMENTS 7,411,769 B2 * 8/2008 Schimanski ..... H01T 4/06 335/6
8,873,217 B2 10/2014 Hierl et al. ..... 361/257
(Continued)

FOREIGN PATENT DOCUMENTS

DE 4241311 C2 * 6/1995 ..... H01H 37/76
DE 19545505 C1 5/1997 ..... H01C 7/12
(Continued)

OTHER PUBLICATIONS

The Written Opinion of the International Searching Authority, in German, which was issued by the International Bureau of WIPO in Applicant's corresponding international PCT application having Serial No. PCT/EP2019/052222, filed on Jan. 30, 2019.
(Continued)

*Primary Examiner* — Thienvu V Tran
*Assistant Examiner* — Sreeya Sreevatsa
(74) *Attorney, Agent, or Firm* — Bodner & O'Rourke, LLP; Gerald T. Bodner; Christian P. Bodner

(57) ABSTRACT

The invention relates to an overvoltage protection arrangement consisting of a horn spark gap accommodated in an insulating housing (1) having a deion chamber. A trigger electrode is located in the ignition area of the horn spark gap. A varistor is also present, electrically connected in series to
(Continued)

Figure 1:
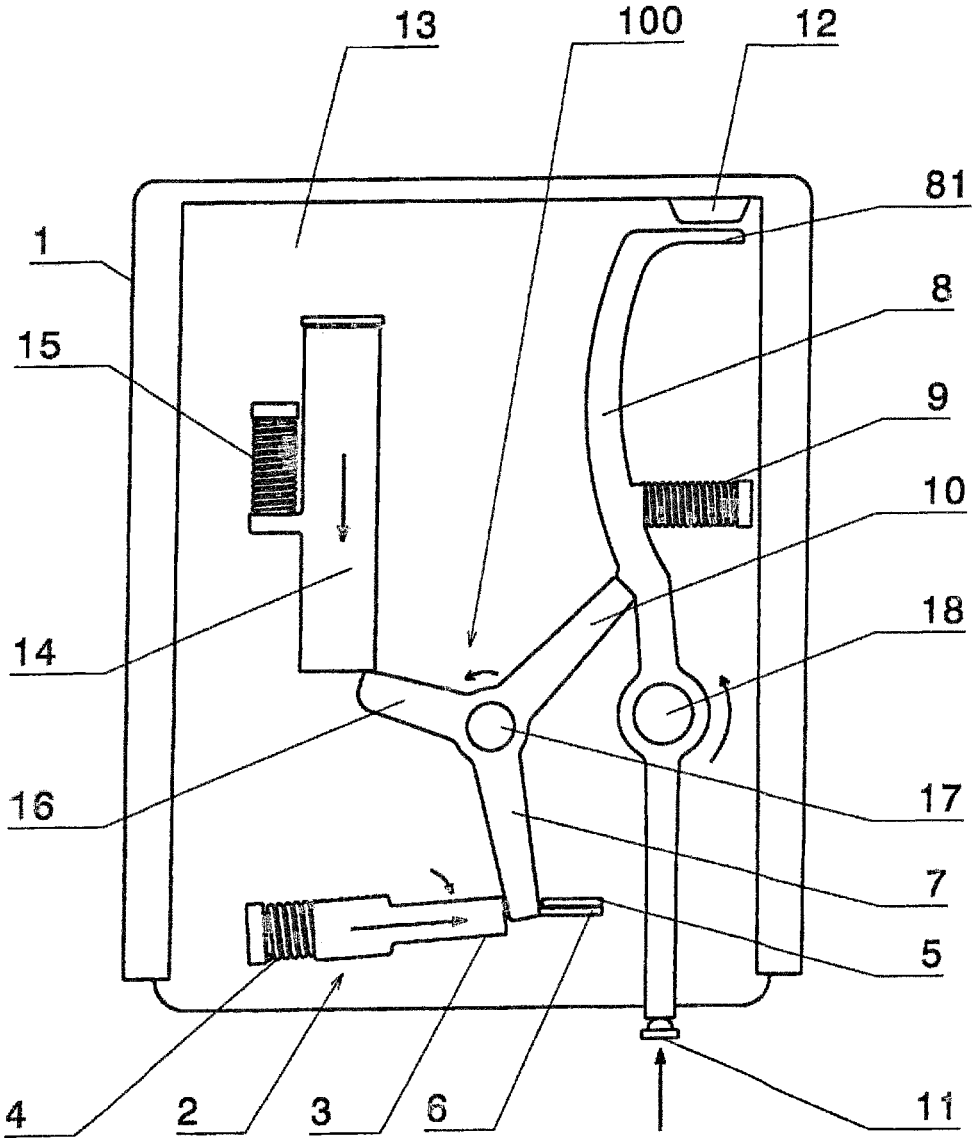

the horn spark gap. According to the invention, a first and a second disconnection apparatus are formed in the housing, wherein the first disconnection apparatus (2) is in heat-conducting connection with the varistor and, when a limit temperature is reached or exceeded, releases a spring-loaded slide (3) which interrupts the series connection between varistor and horn spark gap. Furthermore, the second disconnection apparatus (13) comprises a fusible conductor which is located inside the deion chamber, for example, and can be exposed there to an arc, wherein the fusible conductor holds a spring-loaded disconnector element (14) in a first position and releases this disconnector element (14) when fused as a result of the effects of the arc in such a manner that the disconnector element (14) adopts a second position, wherein an electrical connection to the trigger electrode is interrupted when the second position is reached. A three-pointed, rotatably mounted star or a circular disc with lugs or prongs is formed in the housing such that a first star point (7) is carried along by the slide (3) as it moves to interrupt the series connection. In the same way, a second star point (16) is carried, as the disconnector element (14) moves, from the first to the second position, wherein each movement of the star results in a rotation of the star around its axis of rotation (17) with the consequence that a third point of the star (10) releases a spring-loaded pivoting lever (8) which operates a remote signalling contact (11) and/or a visual fault status display (12).

11 Claims, 4 Drawing Sheets

(51) Int. Cl.

| | |
|---|---|
| ***H01H 85/165*** | (2006.01) |
| ***H01H 85/44*** | (2006.01) |
| ***H01T 1/02*** | (2006.01) |
| ***H01T 4/04*** | (2006.01) |
| *H01H 85/048* | (2006.01) |

(52) U.S. Cl.
CPC ..... *H01H 85/44* (2013.01); *H01T 1/02* (2013.01); *H01T 4/04* (2013.01); *H01H 2085/0486* (2013.01)

(58) Field of Classification Search
USPC ..... 361/112
See application file for complete search history.

(56) References Cited

U.S. PATENT DOCUMENTS

| | | | | |
|---|---|---|---|---|
| 9,083,153 | B2 | 7/2015 | Ehrhardt et al. | |
| 9,449,778 | B2 | 9/2016 | Durth | |
| 10,049,795 | B2 | 8/2018 | Hirschmann et al. | |
| 2011/0032651 | A1* | 2/2011 | Depping | H01H 37/761 361/91.1 |
| 2017/0222433 | A1 | 8/2017 | Fuchs et al. | |

FOREIGN PATENT DOCUMENTS

| | | | | |
|---|---|---|---|---|
| DE | 102006052955 | A1 | 3/2008 | H02H 5/04 |
| DE | 102011051738 | A1 | 2/2012 | H01T 1/08 |
| DE | 102011051738 | A1 * | 2/2012 | H01T 4/14 |
| DE | 102011102937 | A1 | 2/2012 | H01T 2/02 |
| DE | 102011011254 | A1 | 6/2012 | H01C 7/12 |
| DE | 102013019390 | A1 | 4/2015 | H01C 7/12 |
| DE | 102014215280 | B3 | 9/2015 | H01T 1/14 |
| DE | 102014215282 | B3 | 10/2015 | H01H 85/44 |
| EP | 0716493 | B1 * | 7/1998 | H01C 7/12 |

OTHER PUBLICATIONS

The International Search Report, in English, dated Apr. 17, 2019, which was issued by the International Bureau of WIPO in Applicant's corresponding international PCT application having Serial No. PCT/EP2019/052222, filed on Jan. 30, 2019.

The Written Opinion of the International Searching Authority, in German, dated Apr. 17, 2019, which was issued by the International Bureau of WIPO in Applicant's corresponding international PCT application having Serial No. PCT/EP2019/052222, filed on Jan. 30, 2019.

* cited by examiner

OVERVOLTAGE PROTECTION ARRANGEMENT CONSISTING OF A HORN SPARK GAP ACCOMMODATED IN AN INSULATING HOUSING

The invention is based on an overvoltage protection arrangement consisting of a horn spark gap accommodated in an insulating housing having a deion chamber for arc quenching, wherein the deion chamber includes a plurality of spaced quenching metal sheets, and a trigger electrode is located in the ignition area of the horn spark gap, furthermore having a varistor electrically connected in series to the horn spark gap, according to the preamble of claim 1.

Horn spark gap lightning current arresters having a deion chamber are already known from DE 10 2011 051 738 A1, for example.

A corresponding horn spark gap is located in a housing and has means for controlling the internal gas flow for adjusting behavior of the arc generated due to a pulse current load, on the one hand, and the arc caused by large current flow, on the other.

In such a horn spark gap, a trigger electrode can be arranged in the ignition area. This trigger electrode can comprise a conductive element surrounded by a sliding distance. Likewise, adjacent sliding distances can be made of an insulating or semiconducting material. The known trigger electrode is placed either at one of the two electrodes in the ignition area or arranged between the two electrodes of the horn spark gap preferably in the lower area of the ignition area. DE 195 45 505 C1 shows an overvoltage arrester having at least one voltage dependent resistor, for example, a varistor, and thermal disconnection devices.

These disconnection devices consist of a fuse strip, on the one hand, and a thermal trigger device having an eutectic fusible alloy.

When the fuse strip or the thermal fuse is disconnected, a fault indicator will be actuated by means of spring force. An event of damage is then visible.

In order to ensure a display of the occurred fault event with simple means in space-saving construction both in the case of an inadmissible leakage current of the varistor caused by ageing, and in case of an excessive surge current generating a short-circuit in the varistor, a housing is provided in which a surge current resistant fuse strip is located. The damage indicator is a separate component detachably attached to the housing and movable relative to the fuse housing after a spring is released.

The thermal trigger is arranged outside the housing and is in heat-conducting connection with the varistor such that an inadmissible heating of the varistor causes the thermal trigger to be disconnected and the display of damage takes place.

From DE 10 2014 215 282 B3, a combined overvoltage protection apparatus with an integrated spark gap is already known. The spark gap has a series-connected fuse, wherein the series connection is connectable to a supply network having a first potential and a second potential different from the first potential. The spark gap has two main electrodes. Moreover, a housing is present.

The fusible conductor of the fuse connects a first terminal of the housing to the second electrode of the spark gap, wherein the fuse moreover has a further contact, wherein the further contact is arranged to be isolated from a first contact of the fuse and to be isolated from the second main electrode of the spark gap. The overvoltage protection apparatus has a plasma channel leading from the combustion chamber of the spark gap into the vicinity of the fusible conductor such that plasma is able to act upon the fuse wire in a targeted degrading manner. Consequently, the fuse wire may be subjected to destruction.

In the overvoltage arrester having at least one varistor element and a disconnection device according to DE 10 2011 011 254 A1, the disconnection means serves to disconnect the varistor arrester element from the mains, wherein the disconnection device is integrated in the electrical connection path of the arrester arrangement.

The disconnection device comprises a means which couples a fuse into the electrical connection path in the case of thermal overload of the varistor arrester element. Thus, the overvoltage arrester arrangement, in an overload short-circuit condition within the varistor arrester element, is capable to reduce the short-circuit current of the connected power supply or of the connected mains. Consequential damages of connected devices and/or internal connections may be reduced.

Based on the illustrated state of the art, it is a task of the invention to propose a further developed overvoltage protection arrangement consisting of a horn spark gap accommodated in an insulating housing having a deion chamber for arc quenching, which creates the possibility to cause in all imaginable occurring fault events, that means in case of excessive thermal load of the varistor used, but also in case of borderline arcs occurring, a disconnection within the deion chamber, wherein each occurred fault status can be symbolized and, if necessary, remotely signaled by means of a single display device independent of its cause or type.

The solution of the task of the invention is performed by the feature combination according to the teaching of claim 1, wherein the dependent claims comprise at least appropriate configurations and further developments.

Accordingly, an overvoltage protection arrangement consisting of a horn spark gap accommodated in an insulating housing having a deion chamber for arc quenching is taken as a basis. The deion chamber includes a plurality of spaced quenching metal sheets such as shown in DE 10 2011 051 738 A1, for example.

A trigger electrode is located in the ignition area of the horn spark gap so as to make the response behavior of the spark gap adjustable. Moreover, the overvoltage protection arrangement comprises a varistor electrically connected in series to the horn spark gap.

According to the invention, a housing is formed for accommodating the overvoltage protection arrangement, which accommodates a first and a second disconnection apparatus.

The first disconnection apparatus is in heat-conducting connection with the varistor. When a limit temperature is reached or exceeded, a spring-loaded slide is released which interrupts the series connection between varistor and horn spark gap. This thermal disconnection apparatus may comprise a solder joint, for example, changing its physical state when the melting temperature is reached, so that the mentioned slide with the aid of spring force assistance is capable of making the desired movement.

Furthermore, a second disconnection apparatus is present comprising a fusible conductor which can be located inside the deion chamber and be exposed there to a developing arc. In one embodiment, the fusible conductor is contacted to quenching metal sheets of the deion chamber and melts upon load, in particular upon large load current flow.

The fusible conductor is capable of holding a spring-loaded disconnector element in a first position, but also of releasing this disconnector element when fused as a result of the effects of the arc in such a manner that the disconnector element adopts a second position. When the second position has been reached, an electrical connection to the trigger electrode is interrupted. Due to the occurred overload, a new ignition of the spark gap is no longer possible.

Furthermore, a three-pointed, rotatably mounted star or a circular disc with lugs is formed in the housing such that a first star point or lug is carried along with a star point end by the slide as it moves to interrupt the series connection.

In the same way, a second star point or lug can be carried along with its star point end upon a movement of the disconnector element from the first to the second position, wherein, as a result of the respective entrainment movement, the star or the disc is subjected to a rotation about its axis of rotation. As a consequence, a third start point or lug, with its star point end, releases a spring-loaded pivotable lever which operates a remote signaling contact and/or a visual fault status display.

The respective action of either the slide or the disconnector element upon the rotatably mounted star resulting in the then occurring rotation of the star along with triggering the pivotable lever corresponds to a quasi mechanical "OR" link with respect to the disconnection apparatuses.

According to the invention, the use of the rotatably mounted star or the circular disc allows sensing the respective status of the relevant disconnection apparatus along with the transmission of a mechanical movement to be performed in a very confined space such that the lever mentioned above is released from its position fixed by the third star point.

In one design of the invention, the trigger electrode is in connection with one of the main electrodes of the horn spark gap via a voltage limiting element. The connection mentioned above may be electrically interrupted by means of a disconnecting slide.

In a first housing plane, the housing has the horn spark gap and the varistor, wherein in a second housing plane, at least the disconnector element, the star and the lever as well as an operating protrusion of the slide are formed.

As a result of the disconnecting movement, the slide gets in such a position that two metallic contacts are separated, wherein the slide penetrates into the separating gap and hereby, arcs are prevented from potentially developing.

When reaching the second position, the disconnector element lifts off a spring contact bracket from a contact surface of the voltage switching element so that the desired interruption of the electrical connection may be realized.

Both the slide and the disconnector element consist of an electrically insulating material.

The lever for status display is mounted to be pivotable in the housing and, at a first lever end, has an angulation which releases or covers a display surface, wherein an operating lug for the remote signaling contact is formed at a second lever end.

The display surface may in this case preferably be a housing surface or a window in the housing.

The axis of rotation of the star or the disc and the pivot axis of the lever preferably are parallel to one another and have such a spacing that, when the star is rotated from a stop position, the third point of the start may be transferred into a release position with respect to the lever.

At least the axis of rotation, the pivot axis, the star and the lever are components of a housing insert part located in the second housing plane. This housing insert part forms a partition with respect to a housing plane situated below, where the horn spark gap and the varistor are located.

The overvoltage protection arrangement may be formed as a plug-in part with plug contacts for accommodation in a base part. The plug contacts are in this case preferably situated at an underside of the plug-in part. Side surfaces of the plug-in part may have latching elements for fixing the plug-in part in the base part, or also may have means for locking or unlocking these latching elements as well as for pulling out the plug-in part from the base part more easily.

In a preferred embodiment of the invention, the fusible conductor of the second disconnection apparatus is contacted to two selected and spaced quenching metal sheets.

The voltage limiting element is preferably formed as a gas arrester.

The invention will be explained in more detail on the basis of an exemplary embodiment and with reference to Figures.

Figure 2:
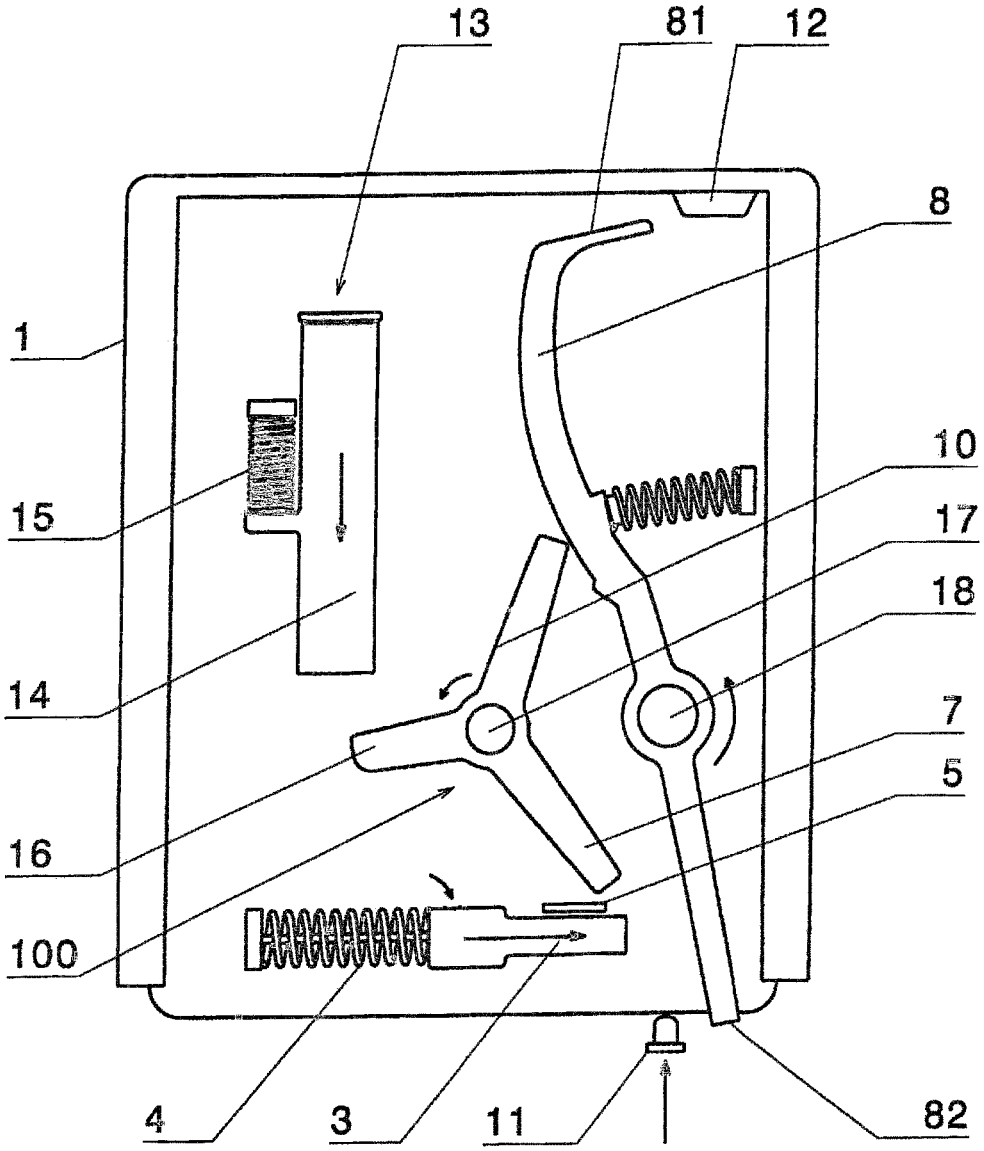
Figure 3:
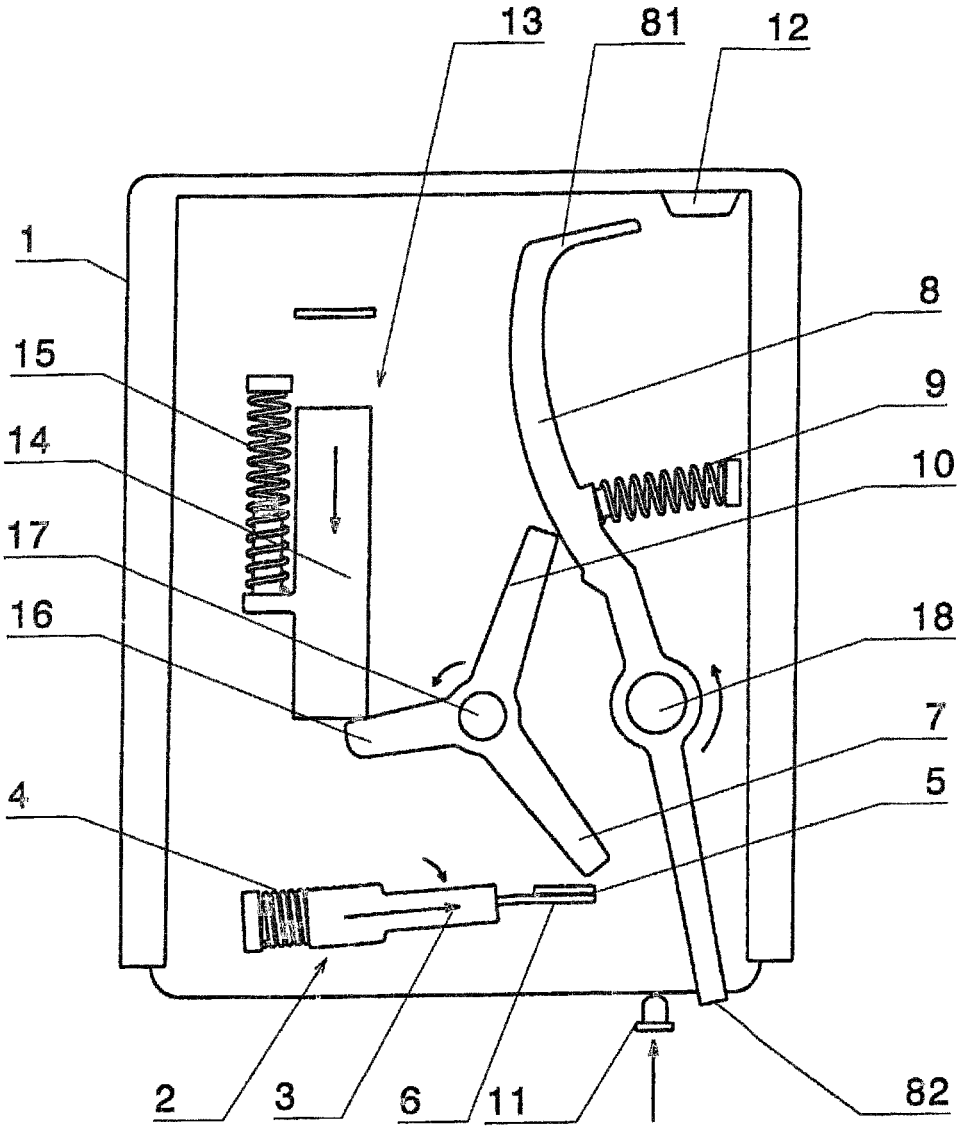
Figure 4:
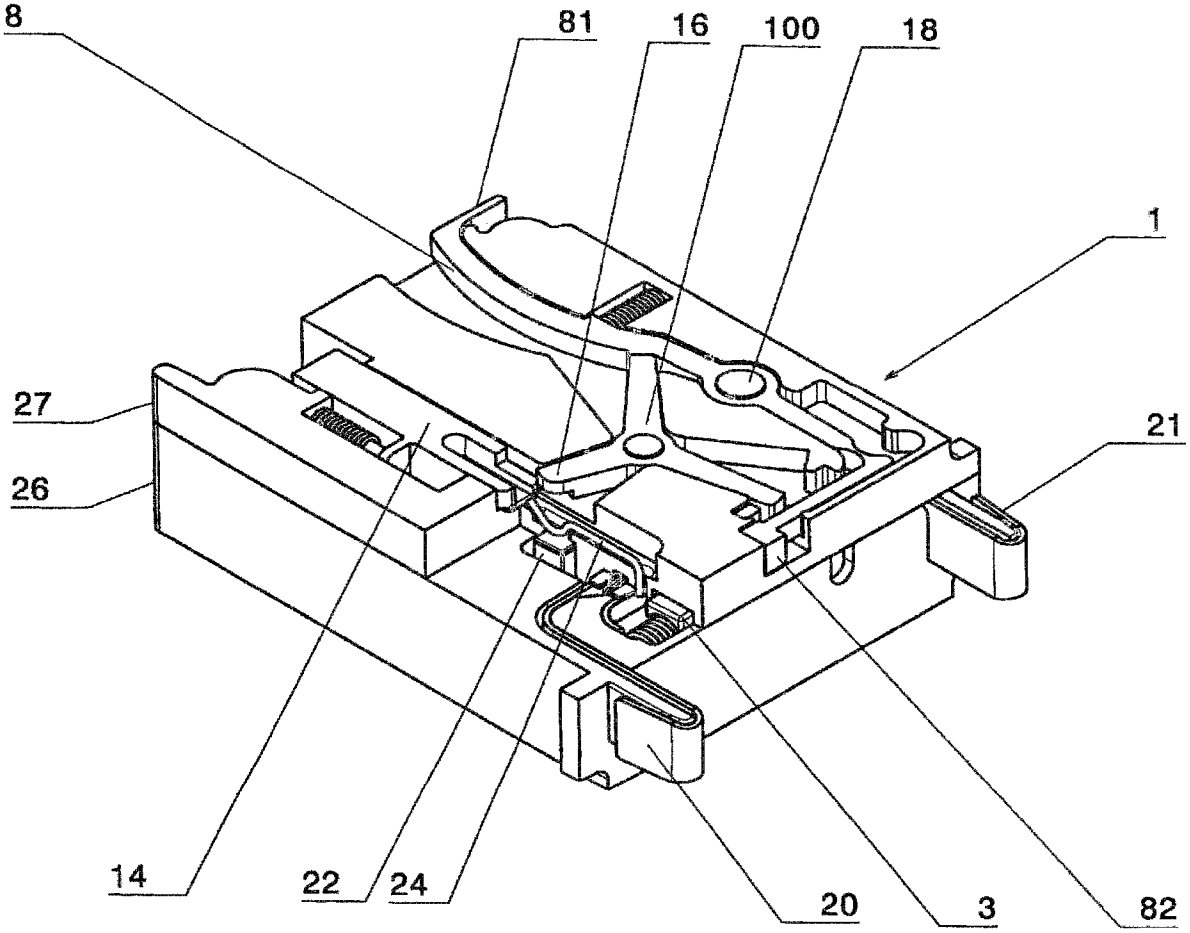

Shown are in:

FIG. 1 a principle representation of an overvoltage protection arrangement having an illustrated first and second disconnection apparatus in addition to a rotational star and a lever function display in a state of complete function of the employed overvoltage arresters, in particular a horn spark gap and a varistor;

FIG. 2 a representation similar to that of FIG. 1, however, in the state of the first disconnection apparatus with the slide being triggered and the hereby resulting rotational movement of the star in addition to the releasing of the lever for the spring display;

FIG. 3 a representation similar to that of FIG. 2, however, here with a triggered second disconnection apparatus, wherein the disconnector element entrains the rotational star, so that the rotational star in turn may release the lever for status display; and FIG. 4 a perspective representation of a overvoltage protection arrangement formed as a plug-in part with a housing partially broken away and a discernible housing insert part (upper part) in addition to a rotational star, lever and the disconnector element of the second disconnection apparatus with the detail of a spring contact bracket which is in connection with a contact surface of a gas arrester when in the proper state.

The overvoltage protection arrangement shown in the Figures takes a housing 1 as a basis.

In this housing, a horn spark gap that is not shown having a deion chamber for arc quenching is located.

In a manner known per se, the deion chamber has a plurality of spaced quenching metal sheets.

In the ignition area of the horn spark gap, a trigger electrode is located that is not shown.

Furthermore, a varistor (not shown) electrically connected in series to the horn spark gap is located in the housing.

Inside the housing 1, a first and a second disconnection apparatus are located.

The first disconnection apparatus 2 is in heat-conducting connection with the varistor that is not shown. When a limit temperature is reached or exceeded, the slide 3 is released which is mounted on a guide (see FIG. 2) while being spring-loaded by a spring 4. In the proper operational state, the electrical connection between the contacts 5 and 6 is closed.

In the overload event of the varistor that is not shown (see FIG. 2), a movement of the slide in the arrow direction takes place. As a consequence, the slide 3 gets into the space between the contacts 5 and 6 with its front end resulting in the desired interruption of the respective current circuit.

On this occasion, the slide pushes a first point 7 of a rotatably mounted star with its front edge.

As a consequence, the star rotates in the arrow direction so that the lever 8 is released (see FIG. 2). Hereby, the movement of the lever 8 is further assisted by a further spring 9.

The third star point 10 thus releases the lever 8.

This allows a remote signaling contact 11 to be triggered or a status display in terms of the positional change of the lever 8 be performed with respect to a display window 12 in the housing 1.

Furthermore, a second disconnection apparatus 13 comprising a fusible conductor (not shown) is present. This fusible conductor is located in the deion chamber that is not shown and the fusible conductor is exposed to a developing arc.

The fusible conductor of the second disconnection apparatus 13 holds a spring-loaded disconnector element 14 in a first position. The spring force assistance is performed by a third spring 15.

After fusing of the fusible conductor due to the effects of an arc or a large load current flow, the disconnector element 14 is released. The consequence is that the disconnector element 14 adopts its second position as shown in FIG. 3.

When the second position is reached, a respective end of the disconnector element 14 acts upon a second point 16 of the rotatably mounted star.

This is illustrated in FIG. 3.

Here, as well, the consequence is that the rotatably mounted star executes a rotational movement, wherein the third point 10 of the star performs a positional displacement and releases the lever 8 in the same way as explained on the basis of FIG. 2.

The axes of rotation 17 and 18 of the star, on the one hand, and the lever, on the other, have a spacing from one another and are mutually parallel.

In the perspective representation of FIG. 4, it is obvious that the overvoltage protection arrangement can be formed as a plug-in part having plug contacts 20 and 21.

On the basis of this representation according to FIG. 4 with a housing partially broken away, a gas arrester 22 is recognizable comprising a contact surface on one of its front faces.

A corresponding spring contact 24 rests upon the contact surface of the gas arrester with its bracket-side end.

Upon a movement of the disconnector element 14 toward the spring bracket 24, an end of the disconnector element is pushed into the space between the spring bracket and the contact surface of the gas arrester 22, so that the current flow of the trigger circuit is interrupted. As already explained on the basis of FIG. 3, the disconnector element 14 simultaneously pushes the point 16 of the rotatably mounted star so as to release the lever 8 of the display and fault signaling device.

It is also apparent from the representation according to FIG. 4 that the housing has a first, lower plane 26 accommodating the horn spark gap and the varistor. A second, overlying housing plane 27 accommodates at least the disconnector element 14, the start with its star points, the lever 8 as well as an operating protrusion of the slide 3.

It is apparent from the representations that the lever 8 is mounted to be pivotable by means of the axis 18.

At a first lever end 81, the lever 8 has an angulation which releases or covers a display surface, wherein an operating lug for the remote signaling contact 11 is formed at a second lever end 82.

The invention claimed is:

1. An overvoltage protection arrangement consisting of a horn spark gap accommodated in an insulating housing (1) having a deion chamber for arc quenching, wherein the deion chamber includes a plurality of spaced quenching metal sheets, and a trigger electrode is located in the ignition area of the horn spark gap, furthermore having a varistor electrically connected in series to the horn spark gap, characterized in that inside the housing (1), a first and a second disconnection apparatus are formed, wherein the first disconnection apparatus (2) is in heat-conducting connection with the varistor, and when a limit temperature is reached or exceeded, releases a spring-loaded slide (3) which interrupts the series connection between varistor and horn spark gap, furthermore the second disconnection apparatus (13) has a fusible conductor located in the area of the deion chamber, wherein the fusible conductor holds a spring-loaded disconnector element (14) in a first position and releases this disconnector element upon fusing caused by load in such a manner that the disconnector element (14) adopts a second position, wherein an electrical connection to the trigger electrode is interrupted when the second position is reached, furthermore, a three-pointed, rotatably mounted star or a disc is formed in the housing (1) such that a first star point (7) is carried along by the slide (3) as it moves to interrupt the series connection, and in the same way, a second star point (16) is carried along as the disconnector element (14) moves from the first to the second position, wherein each pushing movement of the star results in a rotation of the star around its axis of rotation with the consequence that a third star point (10) releases a spring-loaded pivotable lever (8) which operates a remote signaling contact (11) and/or a visual fault status display (12).

2. The overvoltage protection arrangement according to claim 1, characterized in that the trigger electrode is in connection with one of the main electrodes of the horn spark gap via a voltage limiting element, and said connection being interruptible by means of the disconnector element (14).

3. The overvoltage protection arrangement according to claim 2, characterized in that the voltage limiting element is formed as a gas arrester (22).

4. The overvoltage protection arrangement according to claim 1, characterized in that in a first housing plane (26), the housing has the horn spark gap and the varistor, and wherein in a second housing plane (27), the housing has at least the disconnector element (14), the star (100) and the lever (8), as well as an operating protrusion of the slide (3) are formed.

5. The overvoltage protection arrangement according to claim 2, characterized in that when reaching the second position, the disconnector element (14) lifts off a spring contact bracket (14) from a contact surface of the voltage limiting element (22) and thus interrupts the electrical connection.

6. The overvoltage protection arrangement according to claim 1, characterized in that the slide (3) and the disconnector element (14) consist of an electrically insulating material.

7. The overvoltage protection arrangement according to claim 1, characterized in that the lever (8) is mounted to be pivotable in the housing (1) and, at a first end of the lever (81), has an angulation which releases or covers a display surface, wherein an operating lug for the remote signaling contact (11) is formed at a second end of the lever (82).

8. The overvoltage protection arrangement according to claim 7, characterized in that the axis of rotation (17) of the star (100) and the pivot axis (18) of the lever (8) are parallel to one another.

9. The overvoltage protection arrangement according to claim 8, characterized in that at least the axis of rotation (17) of the star, the pivot axis (18), the star (100) and the lever (8) are components of a housing insert part located in the second housing plane (27).

10. The overvoltage protection arrangement according to claim 1, characterized in that it is formed as a plug-in part with plug contacts (20; 21) for accommodation in a base part.

11. The overvoltage protection arrangement according to claim 1, characterized in that the fusible conductor is contacted to two spaced quenching metal sheets of the deion chamber.

* * * * *